US006186308B1

(12) United States Patent
Coyne et al.

(10) Patent No.: US 6,186,308 B1
(45) Date of Patent: Feb. 13, 2001

(54) REVERSE VENDING MACHINE

(75) Inventors: John A. Coyne, Milwaukie; Stuart R. Aldrich, Portland; Griffin S. Hampson, Portland; Kris M. Kiva, Portland, all of OR (US)

(73) Assignee: Can & Bottle Systems, Inc., Portland, OR (US)

( * ) Notice: Under 35 U.S.C. 154(b), the term of this patent shall be extended for 0 days.

(21) Appl. No.: 09/296,454

(22) Filed: Apr. 21, 1999

(51) Int. Cl.[7] ..... G07F 7/06
(52) U.S. Cl. ..... 194/209; 194/213; 209/930
(58) Field of Search ..... 194/208, 209, 194/212, 213; 209/930; 100/902; 232/43.1, 43.2

(56) References Cited

U.S. PATENT DOCUMENTS

| | | | | |
|---|---|---|---|---|
| 3,249,203 | | 5/1966 | Aidlin . | |
| 3,556,282 | | 1/1971 | Moeltzner . | |
| 3,635,325 | | 1/1972 | Sterling . | |
| 3,690,437 | | 9/1972 | Kammann . | |
| 3,792,765 | | 2/1974 | Arp . | |
| 4,069,928 | | 1/1978 | Teske et al. . | |
| 4,241,821 | | 12/1980 | Wu et al. . | |
| 4,345,679 | | 8/1982 | DeWoolfson . | |
| 4,445,430 | | 5/1984 | Pyne et al. . | |
| 4,454,028 | * | 6/1984 | Vetter et al. | 194/212 X |
| 4,480,737 | | 11/1984 | Jamgochian et al. . | |
| 4,505,370 | | 3/1985 | Swenck . | |
| 4,512,253 | | 4/1985 | La Barge et al. . | |
| 4,653,627 | | 3/1987 | Hampson et al. | 194/209 |
| 5,090,031 | | 2/1992 | Pyne et al. | 377/6 |
| 5,152,387 | | 10/1992 | Hammond | 194/208 |
| 5,161,661 | | 11/1992 | Hammond | 194/209 |
| 5,165,564 | * | 11/1992 | Prout et al. | 232/43.2 X |
| 5,273,150 | | 12/1993 | Koivisto et al. | 194/209 |
| 5,361,913 | * | 11/1994 | Melchionna | 194/209 X |
| 5,624,018 | * | 4/1997 | Scuff et al. | 194/209 |

* cited by examiner

*Primary Examiner*—F. J. Bartuska
(74) *Attorney, Agent, or Firm*—Kolisch, Hartwell, Dickinson, McCormack & Heuser

(57) ABSTRACT

A reverse vending machine is configured to selectively accept bulk fed containers, the machine including an in-feed station with an in-feed door and a hopper accessible via the in-feed door, the hopper having a first mouth which is open when the in-feed door is in an open orientation and closed when the in-feed door is in a closed orientation. The in-feed door has a second mouth, which is smaller than the first mouth, and which remains open regardless of in-feed door orientation. The in-feed station thus is configured to simultaneously freely receive multiple disarrayed containers through the first mouth when the in-feed door is in the open orientation and is configured to receive containers through the second mouth when the in-feed door is in the closed orientation.

25 Claims, 6 Drawing Sheets

REVERSE VENDING MACHINE

TECHNICAL FIELD

The present invention relates generally to recycling, and more particularly, to a machine for redeeming recyclable beverage containers of the type which carry optically-readable information codes.

BACKGROUND ART

In recent years, many states have enacted legislation which requires that beverage containers carry a redemption deposit as a technique for encouraging recycling and discouraging littering, at least of such redeemable containers. In other states, there have been extensive efforts to encourage voluntary recycling of beverage containers, even in the absence of required redemption deposits. As such, there has developed a need for efficient systems whereby beverage containers such as aluminum cans, plastic bottles, and glass bottles may efficiently be processed upon their return.

Retail outlets, which often must act as redemption centers, have had to utilize personnel to sort and count returned containers so that such containers could be returned to the proper distributor for redemption. This arrangement has required devotion of an inordinate amount of personnel time, and an inordinate proportion of the available floor space. Recycling thus has proven unacceptably expensive to most retail outlets and dedicated redemption centers. Accordingly, redeemers of beverage containers have sought a machine capable of automatically accepting redeemable containers and refunding the redeemer in the form of a monetary deposit refund, or a coupon for redemption at a retail store. Container redeemers also have sought a machine capable of receiving containers in bulk so as to simplify loading of containers into the machine. Additionally, container redeemers have sought a machine capable of recording a number of returned containers of each acceptable type such that a redemption refund may be charged against the proper distributor without hand-sorting and recording of returned bottles and cans. Further, a machine capable of efficiently reducing the volume of accepted containers has been sought in order to address deficiencies in available storage space. To this end, there has been a flurry of activity in the development of conveniently used reverse vending machines, and of techniques for the intake, or reverse vending, of recyclable bottles and cans.

One particularly useful reverse vending machine is illustrated and described in U.S. Pat. No. 4,653,627, which issued on Mar. 31, 1987 to Hampson et al. That patent discloses a bulk feed reverse vending machine which provides for the separation counting and crushing of beverage containers such as cans. The invention was improved upon by a machine including a rotary-bristle drive scanning station which aids in accurately identifying containers which are redeemed. That machine is set forth in U.S. Pat. No. 5,273,149, which issued on Dec. 28, 1993 to Aldrich et al. Both of these inventions are commonly owned with the present invention and are incorporated herein by this reference.

Although the aforementioned reverse vending machines have proven extremely effective in the redemption of cans, and particularly in the redemption of standard-size cans, such machines have not addressed the more diverse redemption needs of most redemption centers. For example, known reverse vending machines have provided for pre-loading of the machine with containers, but have not accommodated subsequent in-feed of containers while the pre-loaded containers are processed. Known reverse vending machines also may use complicated and/or ineffective container advancement mechanisms, may be characterized by inaccurate container identification, and may employ unnecessarily complex or ineffective container off-load mechanisms.

SUMMARY OF THE INVENTION

As will be evident from the following description, the invented reverse vending machine is configured to process containers such as beverage containers. The machine includes an in-feed station with an in-feed door and a hopper accessible via the in-feed door, the hopper having a first mouth which is open when the in-feed door is in an open orientation and closed when the in-feed door is in a closed orientation. The in-feed door has a second mouth, which is smaller than the first mouth, and which remains open regardless of in-feed door orientation. The in-feed station thus is configured to simultaneously freely receive multiple disarrayed containers through the first mouth when the in-feed door is in the open orientation, and is configured to receive containers through the second mouth when the in-feed door is in the closed orientation.

The machine also typically includes a container advancement mechanism with a selectively driven wheel which carries a plurality of container carrier elements configured for passage through the in-feed station hopper to capture and advance individual containers along a container advancement path to an off-load station where the containers are selectively discharged either to an acceptable container storage bin, or to an unacceptable container reject port.

The wheel is mounted for rotation about a central axis, a drive motor typically being mounted along the axis of the wheel. In one embodiment, the container carrier elements are defined by through-holes formed in the wheel, each through-hole being configured to receive a container transversely, and being configured to axially engage the container for axial passage of the container along the container advancement path.

The machine may further include a container identifier which employs a roller arrangement positioned along the container advancement path to impart axial rotary motion to containers within the container carrier elements as they pass thereby. An optical scanner also may be positioned along the container advancement path to read codes on the containers during rotation of such containers by the roller arrangement. The optical scanner typically is capable of producing an output signal which in turn is interpretable to identify selected containers as "acceptable" or "unacceptable." A processor typically is employed to count "acceptable" containers which pass through the roller arrangement.

A container selector is positioned adjacent the off-load station to selectively direct off-load of acceptable containers from the container advancement mechanism to a container storage bin. The container selector, for example, may include a first pneumatic jet configured to urge acceptable containers from the container advancement mechanism to the container storage bin, and a second pneumatic jet configured to urge "unacceptable" containers from the container advancement mechanism to a container discharge chute. A container volume reduction mechanism such as a crusher may be mounted intermediate the off-load station and the container storage bin. Containers thus may be crushed or compacted prior to storage.

The "acceptable" containers typically are counted as described above, and the number of "acceptable" containers is recorded by a processor located onboard the machine. The machine then issues a corresponding redemption coupon or receipt, such coupon or receipt indicating a tally of "acceptable" containers counted by the counter during an operating cycle of the machine. The number of containers from each distributor similarly may be counted and recorded so that the proper distributor may be charged for the redemption which is issued by the machine.

As a safety feature, the in-feed door may be configured to define a non-linear channel which provides for passage of containers to the container advancement mechanism, but prevents direct user access to the container advancement mechanism when the in-feed door is closed. Additionally, the reverse vending machine may be configured to disengage the wheel's drive motor when the in-feed door is open, thereby preventing accidental entanglement of the user with the wheel.

These and other objects and advantages of the instant invention will become more fully apparent as the description which follows is read in conjunction with the drawings and the claims.

DETAILED DESCRIPTION OF THE PREFERRED EMBODIMENT

Figure 1:
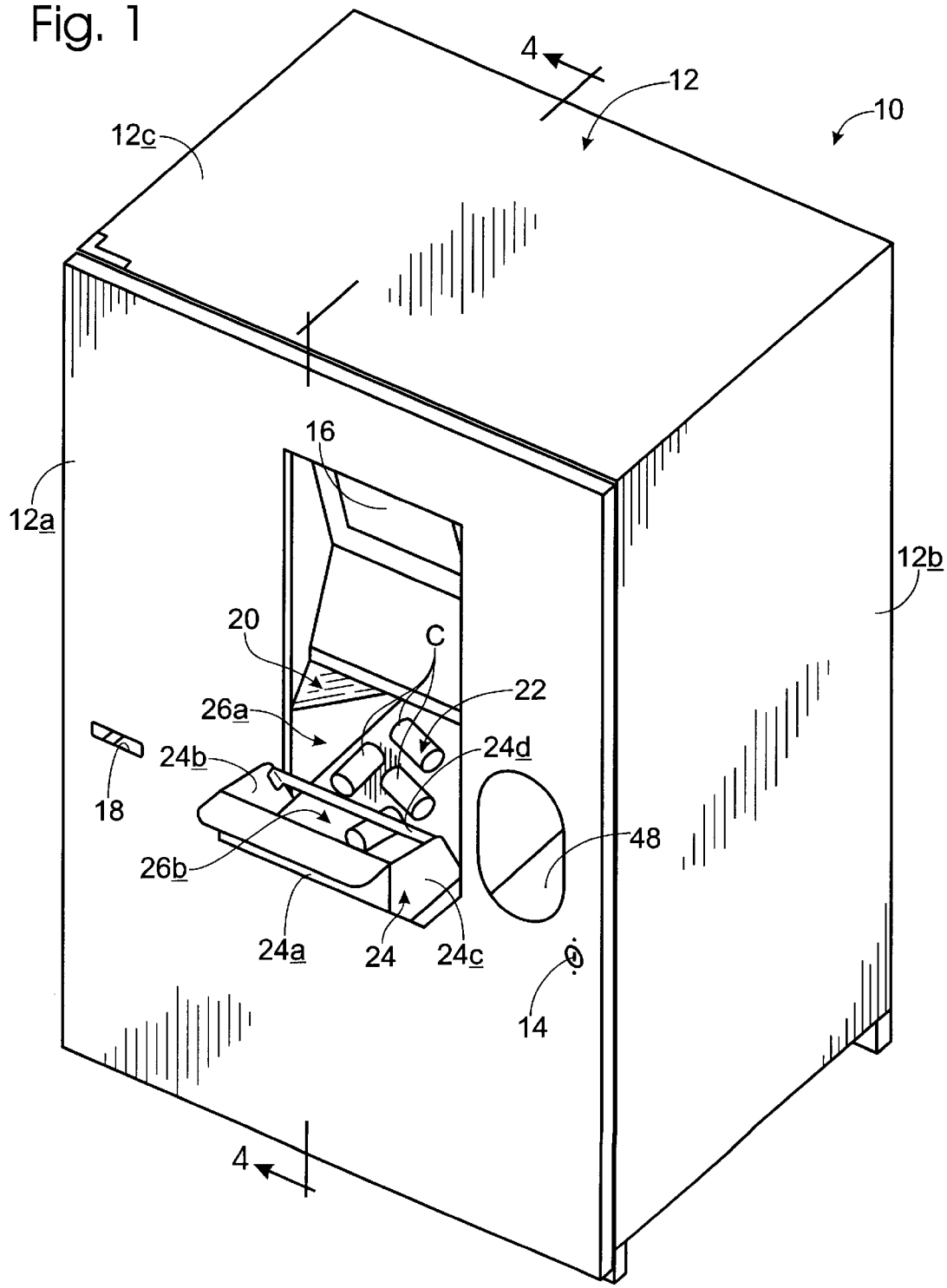
FIG. 1 is an isometric view of a reverse vending machine constructed in accordance with the present invention, the machine's in-feed door being depicted in an open orientation.
Figure 2:
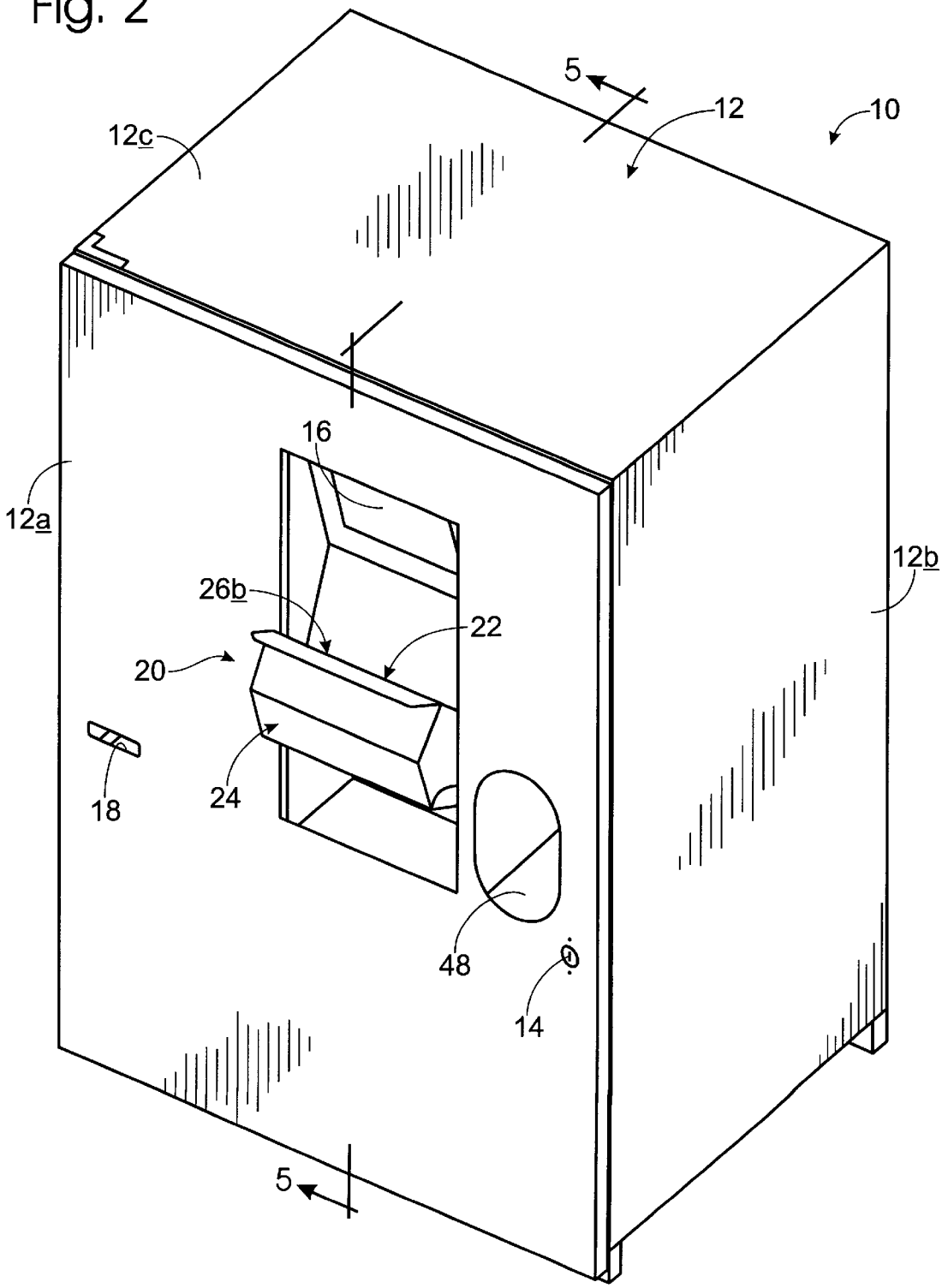
FIG. 2 is an isometric view similar to FIG. 1, but for the reverse vending machine's in-feed door which is shown in a closed orientation.

Referring initially to FIGS. 1 and 2, a reverse vending machine constructed in accordance with the present invention is shown generally at 10. As indicated, the machine includes a substantially rectangular cabinet 12 with a front panel 12*a,* side panels 12*b,* a top panel 12*c* and a rear panel (not shown). The front panel typically is removable, taking the form, generally, of a door which is openable to reveal the interior of the machine. In the depicted embodiment, the door includes a lock 14 which is installed to prevent unauthorized entry into the machine.

As shown, door 12*a* includes a user interface with a screen 16 configured to face a user inserting recyclable beverage containers into the machine. The screen may include a plurality of control buttons configured to provide the user with access to coupons and other information. These control buttons also may be used to determine particular operational parameters of the machine, and/or the character or extent of the machine's display.

Also included on the door is a receipt/coupon output slot 18 which dispenses redemption compensation produced by a redemption mechanism such as a receipt dispensing mechanism contained within cabinet 12. The receipt dispensing mechanism typically provides redemption compensation to the machine's operator corresponding to a tally of acceptable redeemable containers received by the machine during the previous operating cycle of the machine. However, the receipt dispensing mechanism also may be configured to provide coupons to the user, either randomly, or based on the user's request.

In accordance with the invention, the depicted machine is a bulk-feed machine with an in-feed station 20 including a hopper 22 configured to receive multiple disarrayed containers such as those shown at C in FIG. 1. The in-feed station also includes an in-feed door 24 which is pivotal between an open orientation (FIG. 1) and a closed orientation (FIG. 2). When the in-feed door is in the open orientation, the in-feed station is configured to simultaneously freely receive containers into the hopper. When the in-feed door is in the closed orientation, the in-feed station is configured to restrict, but not prevent, receipt of containers into the hopper.

The hopper thus defines a first mouth 26*a* which is open when the in-feed door is in the open orientation and closed when the in-feed door is in the closed orientation. As indicated, the first mouth is relatively large, being of sufficient size to accommodate simultaneous receipt of multiple disarrayed containers therethrough.

The hopper also is accessible via a second mouth 26*b,* which is formed in the in-feed door, and which remains open regardless of in-feed door orientation. The second mouth is smaller than the first mouth, and thus provides more limited access to the hopper than an open first mouth. The in-feed station thus is configured to simultaneously freely receive multiple disarrayed containers through the first mouth when the in-feed door is in the open orientation and is configured to receive containers through the second mouth when the in-feed door is in the closed orientation.

Figure 3:
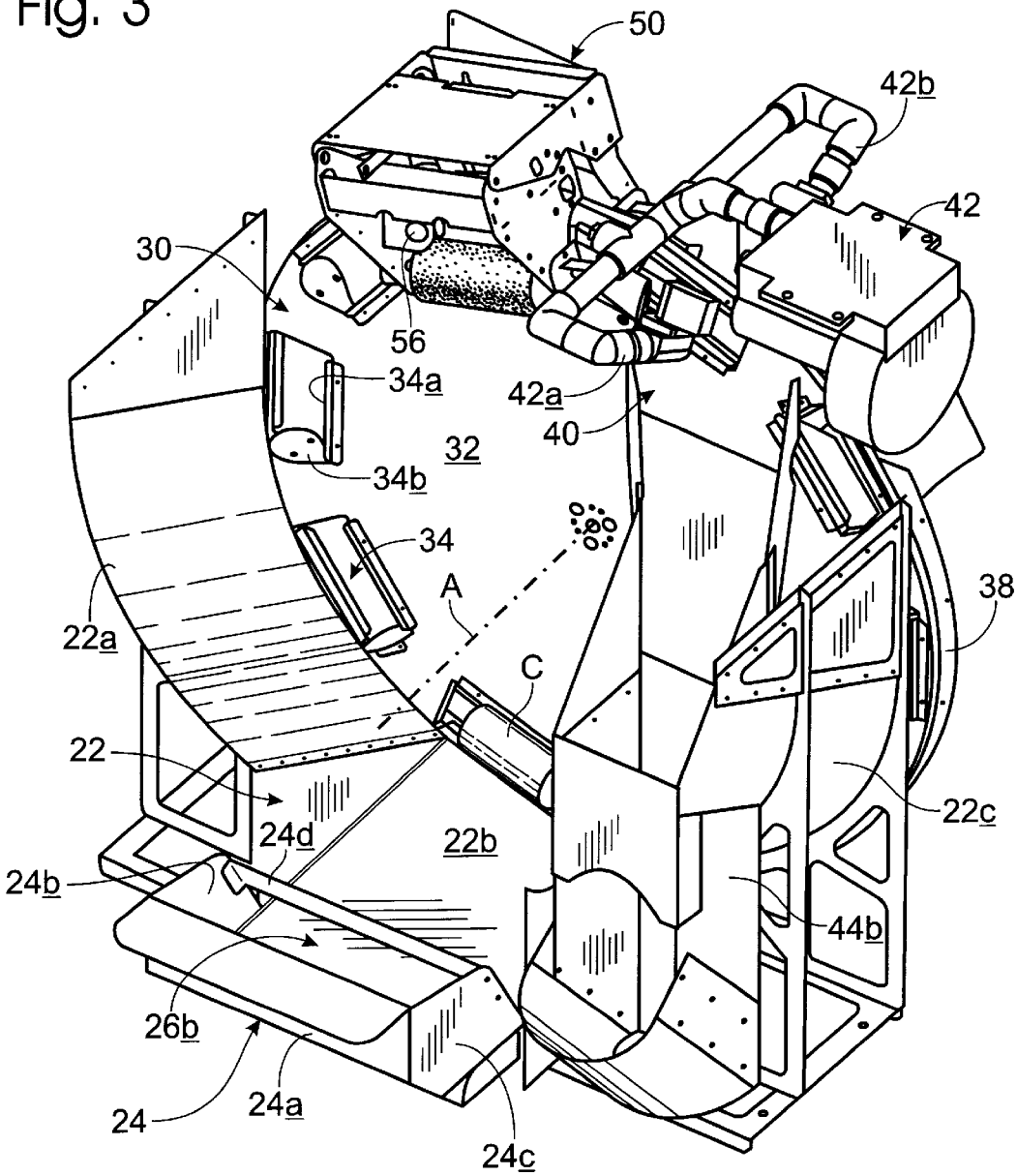
FIG. 3 is a front isometric view showing the interior of the reverse vending machine depicted in FIG. 1, the machine's frame and panels having been removed to more clearly illustrate the invention.

Referring to FIGS. 1 through 3, it will be noted that the in-feed door is somewhat trough-shaped, including a front wall 24*a,* a pair of opposite side walls 24*b,* 24*c,* and a partial rear wall 24*d.* As indicated, these walls collectively define second mouth 26*b.* The in-feed door thus defines a non-linear channel configured to provide for passage of containers into the hopper. This non-linear channel is configured to prevent direct user access to the hopper when the in-feed door is closed.

Once in the hopper, containers are collected by a container advancement mechanism 30, and advanced to an off-load station 40 where acceptable containers are offloaded to a container storage bin. One such container is illustrated in FIG. 3 at C, container C taking the form of a beverage can of the variety conventionally used to hold a soft drink. It will be appreciated, however, that various size and type containers may be received for redemption.

Figure 4:
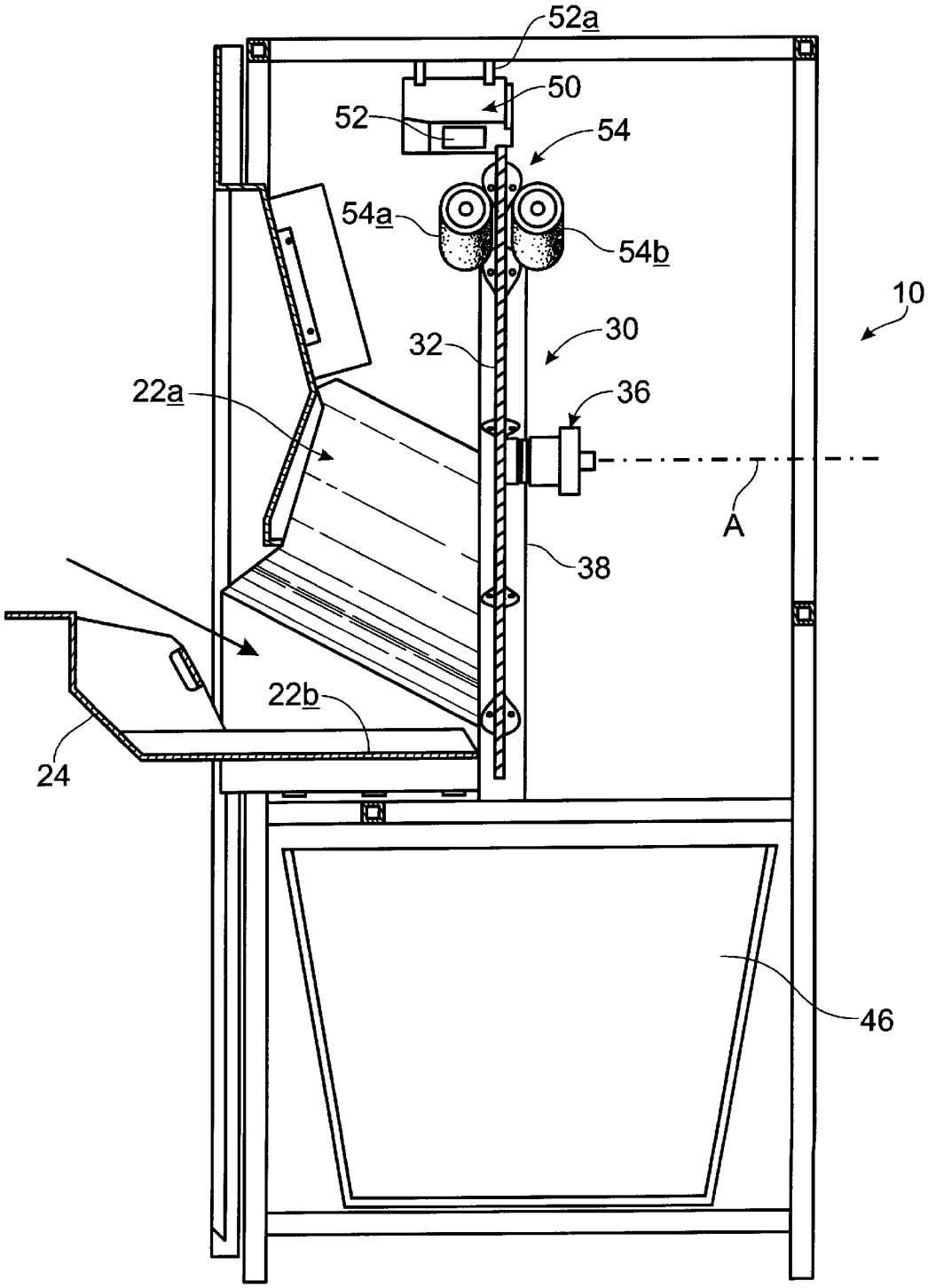
FIG. 4 is a simplified right side sectional view of the reverse vending machine as configured in FIG. 1.
Figure 5:
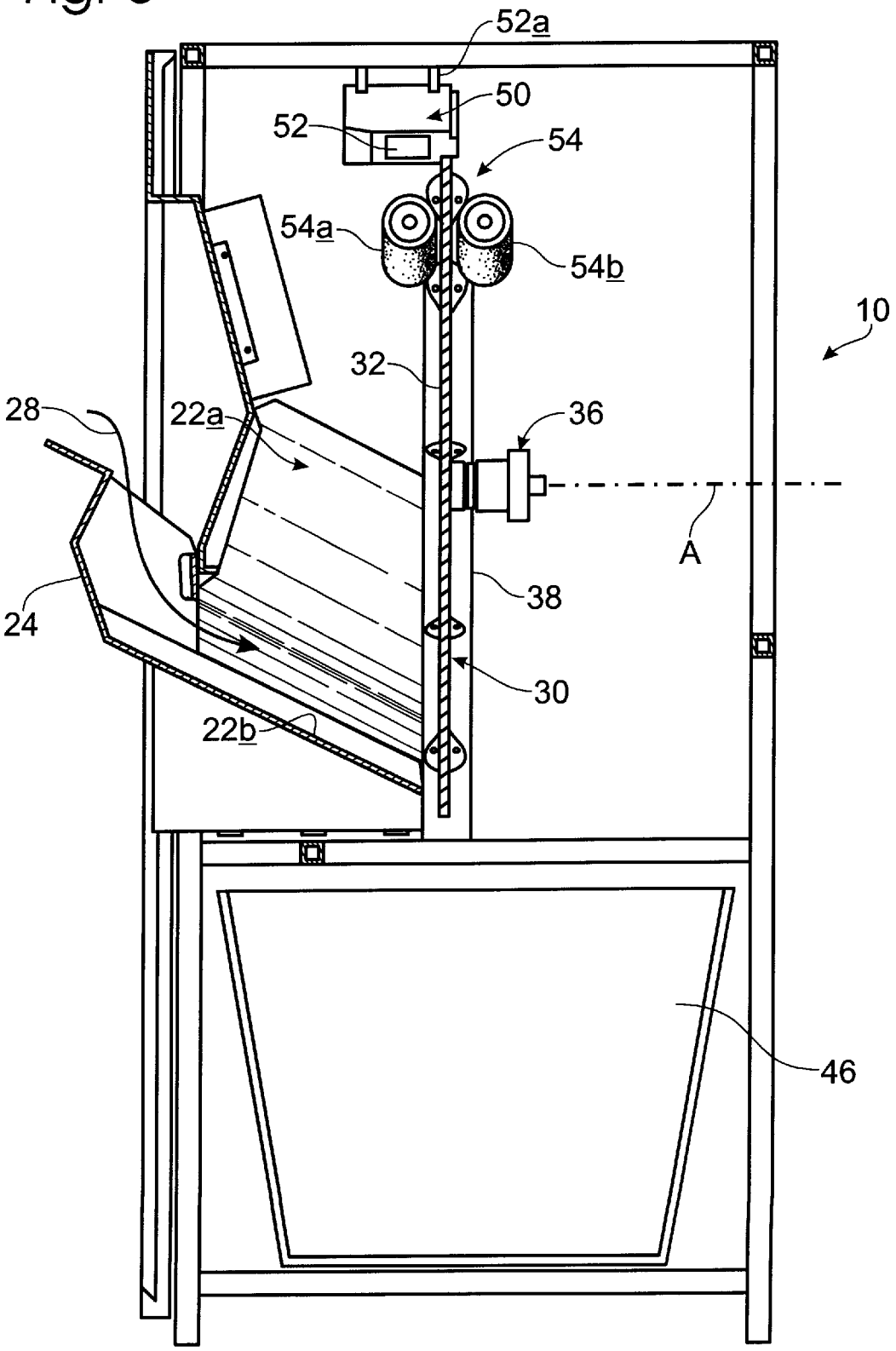
FIG. 5 is a simplified right side sectional view of the reverse vending machine as configured in FIG. 2.

As indicated in FIG. 3, hopper 22 is shaped to direct containers toward the container advancement mechanism, the hopper including a first arcuate section 22*a*, a central section 22*b,* and a second arcuate section 22*c.* The first and second arcuate sections are sloped toward the container advancement mechanism. The central section is pivotal with the in-feed door between a first position where the central section is generally horizontal (FIGS. 3 and 4) and a second position where the central section is sloped toward the container advancement mechanism (FIG. 5).

The container advancement mechanism includes a wheel 32 having a plurality of container carrier elements 34 which receive containers for direction along an arcuate container advancement path. In the depicted embodiment, the wheel is configured for clockwise rotation about a primary axis A, the wheel typically being driven by a motor 36 which is mounted along the primary axis of the wheel.

The container carrier elements are defined by container-receiving cavities, or through-holes, 34*a* which are formed in the wheel along a perimeter thereof. Each container-receiving cavity is configured to receive a container transversely and to axially engage the container for axial passage of the container along the container advancement path. Accordingly, it will be noted that each container-receiving cavity defines a container support platform 34*b* which engages the container to direct the container along the container advancement path as the wheel rotates. A stationary back plate 38 also may be employed to prevent the container from falling through the cavities to the other side of the wheel.

As a safety feature, driven passage of the container carrier elements through the in-feed station is discontinued when the in-feed door is open. This typically is accomplished via a sensor which detects an open in-feed door, and correspondingly interrupts operation of motor 36. It also will be appreciated that, when the in-feed door is closed, direct user access to the container advancement mechanism is prevented due to the configuration of non-linear channel 28 (FIG. 5).

Once containers are collected by the container advancement mechanism, they pass by a container identifier 50 where containers are identified as "acceptable" or "unacceptable". Typically, the container identifier includes an optical scanner 52 configured to identify a container rotated by a roller arrangement 54. Here, the roller arrangement includes a pair of rollers 54*a*, 54*b* mounted on opposite sides of wheel 32. The rollers rotate containers within the container-receiving cavities as the wheel itself rotates. The scanner is mounted on a stationary mounting bracket 52*a* which holds the scanner in the vicinity of wheel 32.

Scanner 52 preferably is capable of reading a code on the beverage container, and optimally is configured to optically read side-borne bar codes of the type used to identify most products which are sold retail. These codes, it will be noted, generally contain information which identifies the distributor, information which may be necessary to automatically charge individual distributors for containers. Upon completing its scan of the container, the scanner produces an output signal which is interpretable to identify the container as "acceptable" or "unacceptable". The signal typically is sent to an onboard processor which counts the number of acceptable containers attributable to each distributor, and which directs operation of the machine. The processor, for example, may be used to direct operation of the container advancement mechanism, to direct operation of the user interface, and to direct dispensing of receipts.

Conventionally, bar codes may be in the form of "fence-style" or "ladder-style codes", either of which may be read by scanners of conventional design. An omni-scanner, for example, may be used to read both ladder- and fence-style codes, or a pair of single-line scanners may be used to cover the possibility of both styles of bar codes. Alternatively, one single-line scanner may be used by positioning the scanner in a position to read fence-style codes (or ladder-style codes), or by providing for pivoting the scanner upon passage of a predetermined amount of time without scanning a code.

The container identifier also may include a metal detector 56 which determines whether the container is made of metal. This information can be useful in ensuring that the machine is not cheated, as by inserting homemade objects with "acceptable" codes printed thereon.

After passing through the container identifier, containers are advanced along the container advancement path to off-load station 40 from which they are directed down an appropriate off-load chute. Typically, the containers are off-loaded without interruption to operation of the container advancement mechanism—namely, without interrupting rotation of wheel 32.

Figure 6:
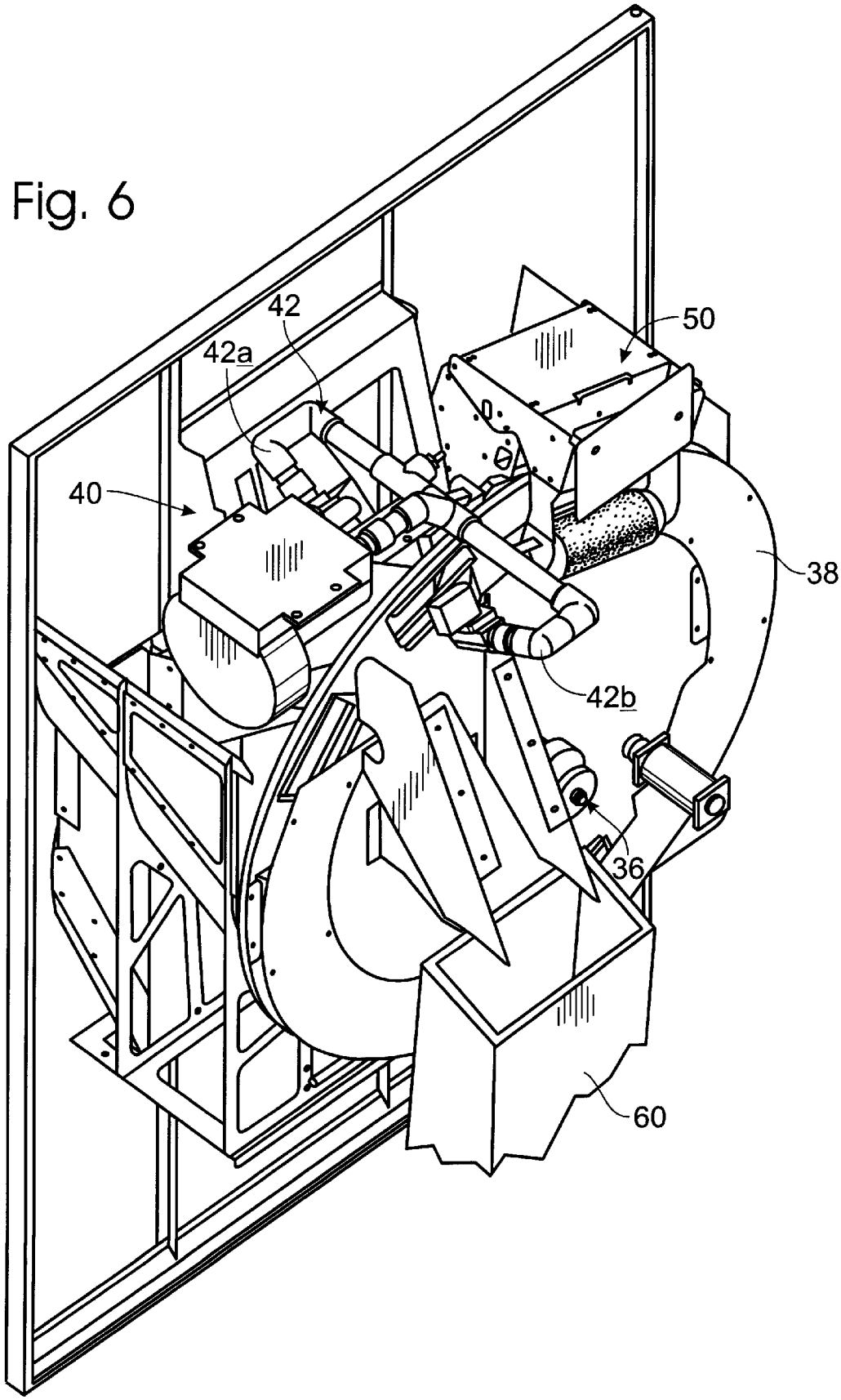
FIG. 6 is a rear isometric view showing the interior of the reverse vending machine depicted in FIG. 1, the machine's frame and panels having been removed to more clearly illustrate the invention.

Referring to FIGS. 3 and 6, it will be noted that off-load station 40 includes a container selector 42 which is configured to selectively effect off-load of containers. In the depicted embodiment, the container selector includes a pneumatic pump which directs off-load of containers via first and second pneumatic jets 42*a*, 42*b*. First pneumatic jet 42*a* is configured to urge "acceptable" containers from the container advancement mechanism, down an acceptable container chute 44*a* to an acceptable container storage bin 46 (FIGS. 4 and 5). Second pneumatic jet 42*b* is configured to urge "unacceptable" containers from the container advancement mechanism, down an unacceptable container discharge chute 44*b* to a reject port 48 (FIGS. 1 and 2) where users may retrieve "unacceptable" containers.

The machine also may be provided with sensors which detect passage of containers from the container advancement mechanism. The sensors each generally include a light source, a reflector, and a photoelectric detector which is capable of identifying the reflected light. When a beam of light from the light source is interrupted by passage of a container between the source and the detector, a signal is transmitted to the processor for interpretation.

In accordance with the invention, the machine also may include a container compacting mechanism 60 which compacts containers to accommodate storage of the containers within acceptable container storage bin 46. The container compacting mechanism typically is disposed between the off-load station and the acceptable container storage bin. One such container compacting mechanism is shown and described in U.S. patent application Ser. No. 08/872,515, which is entitled "Recycling Machine with Container Compacting Mechanism" and which is commonly owned herewith. The subject matter of that application is incorporated herein by this reference.

Although a preferred embodiment of the reverse vending machine has been disclosed, it should be appreciated that variations and modification may be made thereto without departing from the spirit of the invention as claimed.

We claim:

1. A reverse vending machine for processing containers, the reverse vending machine comprising:

an in-feed station including an in-feed door movable between an open orientation wherein the in-feed station is configured to simultaneously freely receive multiple disarrayed containers, and a closed orientation wherein the in-feed station is configured to restrict, but not prevent, receipt of containers;

a container advancement mechanism which includes one or more container carrier elements configured for driven passage through the in-feed station to capture and advance individual containers along a container advancement path;

an off-load station spaced from the in-feed station along the container advancement path, the off-load station including a container selector configured to selectively direct off-load of containers from the container advancement mechanism to a container storage bin while allowing continued passage of the one or more container carrier elements along the container advancement path; and wherein the in-feed station includes a hopper having a first mouth which is open when the in-feed door is in the open orientation and closed when the in-feed door is in the closed orientation, and wherein the in-feed door has a second mouth which defines a non-linear channel configured to provide for passage of containers to the container advancement mechanism, and which remains open regardless of in-feed door orientation so as to provide limited access to the hopper when the in-feed door is in the closed orientation.

2. The reverse vending machine of claim 1, wherein the non-linear channel is configured to prevent direct user access to the container advancement mechanism when the in-feed door is closed.

3. The reverse vending machine of claim 2, wherein driven passage of the container carrier elements through the in-feed station is discontinued when the in-feed door is open.

4. The reverse vending machine of claim 1, wherein the container advancement mechanism includes a wheel having one or more container carrier elements formed therein, the wheel being configured for driven rotation about a primary axis to direct containers along an arcuate container advancement path to the off-load station.

5. The reverse vending machine of claim 4, wherein the wheel is rotated by a motor mounted along the primary axis of the wheel.

6. The reverse vending machine of claim 4, wherein the container carrier elements are defined by container-receiving cavities formed in the wheel.

7. The reverse vending machine of claim 1 which further comprises a container identifier disposed along the container advancement path, the container identifier being configured to identify selected containers as acceptable.

8. The reverse vending machine of claim 7, wherein the container identifier includes a metal detector.

9. The reverse vending machine of claim 7, wherein the container selector includes a first pneumatic jet configured to urge acceptable containers from the container advancement mechanism to the container storage bin.

10. The reverse vending machine of claim 9, wherein the container selector includes a second pneumatic jet configured to urge unacceptable containers from the container advancement mechanism to a container discharge chute.

11. A reverse vending machine for processing containers, the reverse vending machine comprising:

an in-feed station including an in-feed door movable between an open orientation wherein the in-feed station is configured to simultaneously freely receive multiple disarrayed containers, and a closed orientation wherein the in-feed station is configured to restrict, but not prevent, receipt of containers;

a container advancement mechanism which includes one or more container carrier elements configured for driven passage through the in-feed station to capture and advance individual containers along a container advancement path;

an off-load station spaced from the in-feed station along the container advancement path, the off-load station including a container selector configured to selectively direct off-load of containers from the container advancement mechanism to a container storage bin while allowing continued passage of the one or more container carrier elements along the container advancement path; and a container identifier disposed along the container advancement path, wherein the container identifier includes a metal detector, and wherein the container identifier includes a roller arrangement configured to impart rotary motion to a container within a container carrier element, and further includes an optical scanner positioned to read codes on the container during rotation of such container, the optical scanner being capable of producing an output signal which is interpretable to identify selected containers as acceptable.

12. A reverse vending machine for separating, identifying and selectively storing containers, the reverse vending machine comprising:

an in-feed station including an in-feed door and a hopper accessible via the in-feed door, the hopper having a first mouth which is open when the in-feed door is in an open orientation and closed when the in-feed door is in a closed orientation, and the in-feed door having a second mouth, smaller than the first mouth, which remains open regardless of in-feed door orientation, the in-feed station thus being configured to simultaneously freely receive multiple disarrayed containers through the first mouth when the in-feed door is in the open orientation and being configured to receive containers only through the second mouth when the in-feed door is in the closed orientation;

a container advancement mechanism which includes a selectively driven wheel with a plurality of container carrier elements configured for passage through the in-feed station hopper to capture and advance individual containers along an arcuate container advancement path;

a container identifier including a roller arrangement positioned along the container advancement path to impart rotary motion to containers within successive container carrier elements, the container identifier further including an optical scanner positioned to read codes on the containers during rotation of such containers, the optical scanner being capable of producing an output signal which is interpretable to identify selected containers as acceptable; and an off-load station spaced from the in-feed station along the container advancement path, the off-load station including a container selector configured to selectively direct off-load of acceptable containers from the container advancement mechanism to a container storage bin.

13. The reverse vending machine of claim 12, wherein the in-feed door defines a non-linear channel configured to provide for passage of containers to the container advancement mechanism, but prevent direct user access to the container advancement mechanism when the in-feed door is closed.

14. The reverse vending machine of claim 12, wherein driven passage of the container carrier elements through the in-feed station is discontinued when the in-feed door is open.

15. The reverse vending machine of claim 12, wherein the wheel is rotated by a motor mounted along the primary axis of the wheel.

16. The reverse vending machine of claim 12, wherein the container carrier elements are defined by through-holes formed in the wheel, each through-holes being configured to receive a container transversely and axially engage the container for axial passage of the container along the container advancement path.

17. The reverse vending machine of claim 12, wherein the container identifier further includes a metal detector configured to identify acceptable container material.

18. The reverse vending machine of claim 12, wherein the container identifier further includes a counter configured to count acceptable containers passing between the in-feed station and the off-load station during an operating cycle of the reverse vending machine.

19. The reverse vending machine of claim 18 which further comprises a receipt dispensing mechanism for dispensing a receipt indicating a tally of acceptable containers counted by the counter during an operating cycle of the reverse vending machine.

20. The reverse vending machine of claim 12, wherein the optical scanner is capable of identifying the container's distributor by reading the information codes of the container.

21. The reverse vending machine of claim 20, wherein the container identifier further includes a counter configured to count accepted containers from each distributor as such accepted containers pass between the in-feed station and the off-load station.

22. The reverse vending machine of claim 12, wherein the off-load station further includes an unacceptable container reject chute and a receptacle configured to receive unacceptable containers from the off-load station through the reject chute.

23. The reverse vending machine of claim 12, which further comprises a container volume reduction mechanism intermediate the off-load station and the container storage bin.

24. The reverse vending machine of claim 12, wherein the container selector includes a first pneumatic jet configured to urge acceptable containers from the container advancement mechanism to the container storage bin, and a second pneumatic jet configured to urge unacceptable containers from the container advancement mechanism to a container discharge chute.

25. A reverse vending machine for separating, identifying and selectively storing containers, the reverse vending machine comprising:

an in-feed station including an in-feed door and a hopper accessible via the in-feed door, the hopper having a first mouth which is open when the in-feed door is in an open orientation and closed when the in-feed door is in a closed orientation, and the in-feed door having a second mouth which remains open regardless of in-feed door orientation, the in-feed station thus being configured to receive containers through the first mouth when the in-feed door is in the open orientation and through the second mouth when the in-feed door is in the closed orientation;

a container advancement mechanism which includes an axially driven wheel with a plurality of through-holes arranged along a perimeter region of the wheel and configured to receive containers upon passage through the in-feed station hopper, the containers being received within the through-holes transversely and engaged by the wheel to advance the containers along an arcuate container advancement path;

a container identifier including a roller arrangement positioned along the container advancement path to impart axial rotary motion to containers within the through-holes, the container identifier further including an optical scanner positioned to read codes on the containers during rotation of such containers, the optical scanner being capable of producing an output signal which is interpretable to identify selected containers as acceptable, the container identifier further including a counter configured to count acceptable containers passing between the in-feed station and the off-load station during an operating cycle of the reverse vending machine;

a receipt dispensing mechanism for dispensing a receipt indicating a tally of acceptable containers counted by the counter during an operating cycle of the reverse vending machine;

an off-load station spaced from the in-feed station along the container advancement path, the off-load station including a container selector with a first pneumatic jet configured to urge acceptable containers from the container advancement mechanism to a container storage bin, and a second pneumatic jet configured to urge unacceptable containers from the container advancement mechanism to a container discharge chute; and a container volume reduction mechanism intermediate the off-load station and the container storage bin.

* * * * *